United States Patent [19]

Ambrogio

[11] Patent Number: 4,808,195

[45] Date of Patent: Feb. 28, 1989

[54] HYDROCARBON FUEL ADDITIVE

[75] Inventor: Salvatore Ambrogio, Massapequa, N.Y.

[73] Assignee: Aquanon Corp., Portsmouth, N.H.

[21] Appl. No.: 842,992

[22] Filed: Mar. 24, 1986

[51] Int. Cl.[4] ..... C10L 1/18

[52] U.S. Cl. ..... 44/53; 44/77; 44/78

[58] Field of Search ..... 44/53, 56, 77, 78

[56] References Cited

U.S. PATENT DOCUMENTS 2,774,656 12/1956 Newman et al. ..... 44/53
4,002,435 1/1977 Wenzel et al. ..... 44/53
4,477,258 10/1984 Lepain ..... 44/53
4,478,603 10/1984 Mark ..... 44/77
4,601,729 7/1986 Capes et al. ..... 44/53

*Primary Examiner*—William R. Dixon, Jr.
*Assistant Examiner*—Ellen McAvoy

[57] ABSTRACT

A chemical composition having enhanced water elimination capability comprises a dispersant/emulsification agent for use as a supplement additive in a liquid hydrocarbon fuel. The mixture contains ethoxylated nonylphenol and nonylphenol polyethylene glycol ether, an oxygenated organic solvent acting as a hydrophilic agent, and, optionally, a supplemental component of an alcohol acting as an anti-icing agent.

12 Claims, No Drawings

HYDROCARBON FUEL ADDITIVE

The present invention relates to a chemical composition for use as a supplement-additive to gasoline, diesel fuel and heating oil, such additive containing a dispersant for emulsification of water in engines and fuel tanks, thereby eliminating freestanding water associated with repairs and maintenance problems in engines and fuel storage systems and thus preventing rust and corrosion while increasing operating efficiency of the engines and providing detergent action that cleans and purifies the fuel system.

BACKGROUND OF THE INVENTION

It is well known that water and moisture from condensation in internal combustion systems and fuel storage systems result in increased maintenance problems and decrease operating efficiency. Sludge, varnish, gum and carbon deposits derived primarily from sulfuric acid build-up increases wear on fuel systems and engine components, increasing maintenance costs substantially.

Further problems associated with the water phase which is nearly always present in fuel storage systems are the loss of expensive fuel additives from the hydrocarbon fuel to a distinct and separate water phase in contact therewith, known as partitioning, as well as possible icing and bacterial or microbial growth. Such icing and bacterial growth can lead to malfunction of engine systems by clogging fuel filters, freeze-ups of fuel lines, and the like.

Typical commercially available products commonly used to combat the foregoing problems contain as a primary component methanol or another alcohol compound used largely to prevent the icing problems. These commercially available products operate by mixing with the fuel/water mixture in engine and fuel storage systems, allowing the fuel to separate from the water, leaving a water and additive containing phase floating on top of the fuel phase, generally in the form of a milky white liquid. The primary problem of such currently available additives is that, while more or less effectively removing water from the fuel phase, in the fuel storage system, such additives leave the water within the fuel storage system, albeit in a minimally hazardous form, thus diminishing to some extent the fuel storage capacity and permitting additional water condensation within the fuel system to eventually exceed the capacity of the additive to completely eliminate the distinct water phase.

The addition of a polyhydroxy alcohol and/or a glycol ether is known and practiced as a means to inhibit and eliminate microbial growth and resultant metal corrosion within hydrocarbon fuel systems. This, however, has no effect on the water/additive phase which floats atop the fuel phase.

It is apparent from the foregoing discussion that the ideal additive to a hydrocarbon fuel system should eliminate, rather than merely sterilize, the water phase within the hydrocarbon fuel storage system, thus effectively eliminating all of the dangers and maintenance problems associated with water and moisture condensation in such systems.

Accordingly, an object of this invention is to provide a method for eliminating water from a hydrocarbon fuel storage or combustion system.

Other aspects and the numerous advantages of the invention will be apparent to those skilled in the art upon further consideration of the specifications and the appended claims.

According to the invention set forth herein, the existence of a separate water phase within a fuel storage or combustion system is eliminated by the step of adding to the fuel and/or water a chemical composition containing a dispersant which results in the emulsification of all concentrations of water in the system thereby preventing rust and corrosion, increasing operating efficiency, and eliminating the other deleterious effects of water within a fuel containing system. The additive invention thus combined with the untreated hydrocarbon fuel provides a clear, stable, liquid fuel composition by completely emulsifying all water into the hydrocarbon fuel within the system, thus providing a uniform fuel composition that burns efficiently through the combustion process eliminating all freestanding water from the system. This has the further beneficial effect of providing a detergent action which eliminates gum and varnish build-up in fuel valves, lines, pumps, injectors, nozzles and the like, allowing operation at optimum efficiency.

More specifically, it has been found according to the invention, that the addition of about 0.01% by volume of the additive invention herein to bulk fuel storage tanks provides optimal results. The additive is preferably introduced before or during delivery of fuel. Initial treatments for either bulk storage or individual vehicle systems is found to have optimum results from use of a concentration of at least twice the above concentration to provide quick clean-up of existing water deposits in fuel systems.

Thus, according to the invention, there is provided, in a preferred embodiment, a chemical mixture for use as an additive in liquid hydrocarbon fuel and/or water, comprising a chemical compound having hydrophilic qualities selected from the group consisting of ethylene glycol, n-butyl alcohol, ether and cellosolve (methyl ether of ethylene glycol); ethoxylated nonylphenol; nonylphenol polyethylene glycol ether and, optionally, methanol.

More specifically, the invention comprises the foregoing chemicals in a combination comprising, by weight, a hydrophilic agent in the range of 20 to 37%, ethoxylated nonylphenol in the range of 26–35%, nonylphenol polyethylene glycol ether in the range of 32–43% and methanol in a trace amount of less than 0.1% by weight. A still more preferred composition consists of approximately 32% of the hydrophilic agent, 30% of ethoxylated nonylphenol, 38% of the nonylphenol polyethylene glycol ether and approximately 0.06% methanol by weight.

The additive disclosed in the invention represents an improvement over existing additive technology in the following manner: scientific individual comparison of the invention additive to existing additives discloses that the invention performs in an obviously more effective way. Where a quantity of commonly known and commercially available additive is added to, and mixed with, a combination of fuel and water (which exist in separate phase from one and other), the result is that the fuel will separate from the water and fuel additive which appear in combination, apart from the fuel, to form a milky white liquid. The same procedure with the additive taught by the invention, results in the water being emulsified and absorbed into the fuel, resulting in the entire mixture being a uniform, clear liquid. Moreover, the blending effect and the liquid's clarity remain constant, and combustion can be completed without any difference between a combination of fuel and water in one case and a combination of fuel, water and the invention additive in another case.

These differences demonstrate two major qualitative advantages of the invention over the existing additives' technology: Firstly, the invention additive removes water from the fuel system, thereby eliminating or reducing the harmful effects of rust and corrosion. Secondly, the invention additive runs the entire water/fuel mixture through the engine, thereby cleaning and purifying the fuel system in the process of eliminating the water from the fuel tank.

Existing hydrocarbon fuel system additives act primarily as anti-freeze and de-icing agents, i.e., anti-icing agents, and contain strong methanol bases for such purposes. While the invention additive herein may optionally contain a trace amount of methanol, it differs importantly and substantially from existing commonly used additives by completely removing, rather than merely sterilizing, water found in a fuel system. Additionally, the invention additive will disperse and dissipate sludge and harmful deposits which have built up in fuel storage and engine systems.

The following examples are illustrative of, but not in limitation of, the present invention.

EXAMPLE 1

In this example, tests were run to ascertain the relative volumes of water uptake using the invention and two similar products on the market. The test consisted of adding 25 mls. of distilled water to 100 mls. of gasoline, then adding 25 mls. of the invention or each of the two similar products.

As a result of the test, the invention took up all the water in a cloudy suspension which eventually cleared with less than 5 mls. of water remaining. On the contrary, the first of the similar products tested left the volume of water unchanged. The second of the similar products resulted in a 50 mls. layer of water and product.

A further test of an engine run with gasoline so treated by the invention resulted in the smooth running of the fuel system and engine.

EXAMPLE 2

In this example, combustion tests were conducted on gasoline, diesel fuel and heating oil containing the invention. Three beakers were measured with 50 grams of these three fuels. 25 grams of water was added to each beaker. This blend was agitated by propeller Vortex for 5 minutes and appearance was recorded. The beakers were left undisturbed for 30 minutes. After this period 10 grams of the invention were added to each beaker and blended slowly with a stirring rod. The results are recorded below.

| | With Water | With Water and the Invention |
|---|---|---|
| Beaker #1 Gasoline | No mixing | 100% Mixture |
| Beaker #2 Diesel Fuel | No mixing | 100% Mixture |
| Beaker #3 Heating Oil | No mixing | 100% Mixture |

All three beakers were covered, sealed and wicked. After saturation the wick was ignited and allowed to burn. All three fuels burned out completely with no spattering recorded at the wick.

An additional three beakers were blended as above, placed in a petri dish and ignited. The flames were clear and no spattering or boiling was observed.

EXAMPLE 3

In this example, combustion tests were run to compute the quantity of water removed from diesel fuel and gasoline.

ASTM tests D-240 and D-93 were administered to test BTU's and flashpoints. The invention was added to gasoline and diesel fuel in a ration of 15 gallons of fuel to 1 ounce of the invention. One liter of this mixture was titrated with water to determine its maximum absorption. Water was administered from a micro burette in 0.05 increments until excess water was visible. Also, the effects the invention has on sludge were observed subjectively.

| RESULTS: | |
|---|---|
| Gasoline w/invention | 15,470 BTU/lb. |
| Gasoline w/o invention | 16,751 BTU/lb. |
| Diesel w/invention | 19,214 BTU/lb. |
| Diesel w/o invention | 20,031 BTU/lb. |
| Flash Point | 192° F. |
| Water removed by invention | |
| Diesel | 0.25 mls. |
| Gasoline | 0.25 mls. |

The invention was observed to act as a solvent against sludge. It dissolved and dispersed soluble components while breaking up and dispersing insoluble matter.

The invention was found to be an efficient moisture or water removing agent comparing favorably with various dry gas antifreeze products. In addition, it was found to be effective in dispersing sludge which was petroleum in nature from various gasoline or diesel fuel systems.

As will be evident to those skilled in the art, many variations and modifications of this intention can be practiced in view of the foregoing disclosure. Such variations and modifications are believed to clearly come within the spirit and scope of the invention.

What is claimed is:

1. In the method of fuel storage or combustion, wherein the fuel supply contains small amounts of water, the step of adding to said fuel supply an additive comprising a blend of a hydrophilic agent chosen from the group of ethylene glycol, n-butyl alcohol, and cellosolve in the range of 22–37% by weight;

ethoxylated nonylphenol in the range of 26–35% by weight;

nonylphenol polyethylene glycol ether in the range of 32–43% by weight.

2. The method of claim 1 comprising the step of adding to said fuel supply the blend as recited in claim 1, which additionally contains an anti-icing agent in the range of 0.2–1% by weight.

3. The method of claim 1 comprising the step of adding to said fuel supply the blend as recited in claim 1 which additionally contains methanol in the range of 0.2–1% by weight.

4. In the method of fuel storage or combustion, wherein the fuel supply contains small amounts of water, the step of adding to said fuel supply an additive comprising a blend of a hydrophilic agent chosen from the group of ethylene glycol, n-butyl alcohol, and cellosolve in the range of 32% by weight;

ethoxylated nonylphenol in the range of 30% by weight;

nonylphenol polyethylene glycol ether in the range of 38% by weight.

5. The method of claim 4 comprising the step of adding to said fuel supply the blend as recited in claim 4 which additionally contains an anti-icing agent in the amount of 0.6% by weight.

6. The method of claim 4 comprising the step of adding to said fuel supply the blend as recited in claim 4 which additionally contains methanol in the amount of 0.6% by weight.

7. In the method of fuel storage or combustion, wherein the fuel supply contains small amounts of water, the step of adding to said fuel supply an additive in an amount so that said additive is approximately 0.01% by volume of said fuel supply subsequent to said adding step, said additive comprising a blend of a hydrophilic agent chosen from the group of ethylene glycol, n-butyl alcohol, and cellosolve in the range of 22–37% by weight;

ethoxylated nonylphenol in the range of 26–35% by weight;

nonylphenol polyethylene glycol ether in the range of 32–43% by weight.

8. The method of claim 7 comprising the step of adding to said fuel supply the blend as recited in claim 7 which additionally contains an anti-icing agent in the range of 0.2–1% by weight.

9. The method of claim 7 comprising the step of adding to said fuel supply the blend as recited in claim 7 which additionally contains methanol in the range of 0.2–1% by weight.

10. In the method of fuel storage or combustion, wherein the fuel supply contains small amounts of water, the step of adding to said fuel supply an additive in an amount so that said additive is approximately 0.01% by volume of said fuel supply subsequent to said adding step, said additive comprising a blend of a hydrophilic agent chosen from the groupl of ethylene glycol, n-butyl alcohol, and cellosolve in the range of 32% by weight;

ethoxylated nonylphenol in the range of 30% by weight;

nonylphenol polyethylene glycol ether in the range of 38% by weight.

11. The method of claim 10 comprising the step of adding to said fuel supply the blend recited in claim 10 which additionally contains an anti-icing agent in the amount of 0.6% by weight.

12. The method of claim 10 comprising the step of adding to said fuel supply the blend as recited in claim 10 which additionally contains methanol in the amount of 0.6% by weight.

* * * * *